United States Patent [19]

Sumigawa

[11] Patent Number: 4,622,015

[45] Date of Patent: Nov. 11, 1986

[54] STEERING DEVICE FOR AN OUTBOARD MOTOR

[75] Inventor: Yukio Sumigawa, Iwata, Japan

[73] Assignee: Sanshin Kogyo Kabushiki Kaisha, Shizuoka, Japan

[21] Appl. No.: 640,879

[22] Filed: Aug. 15, 1984

[30] Foreign Application Priority Data

Aug. 22, 1983 [JP] Japan ..... 58-151617

[51] Int. Cl.[4] ..... B63H 21/26

[52] U.S. Cl. ..... 440/55; 440/63; 74/480 B

[58] Field of Search ..... 440/55, 900, 87, 63; 74/480 B, 495

[56] References Cited

U.S. PATENT DOCUMENTS

| | | | |
|---|---|---|---|
| 1,161,935 | 11/1915 | Heck et al. | 440/63 |
| 1,451,452 | 4/1923 | Williams | 74/480 B |
| 1,452,900 | 4/1923 | Turner . | |
| 1,593,823 | 7/1926 | Gleason | 440/55 |
| 2,182,596 | 12/1939 | Olsen . | |
| 2,221,101 | 11/1940 | Lefkowitz . | |
| 2,426,001 | 8/1947 | Denault . | |
| 2,682,248 | 6/1954 | Sitz | 74/480 B |
| 2,846,896 | 8/1958 | Allen . | |
| 3,164,032 | 1/1965 | Abbey . | |
| 3,310,021 | 3/1967 | Shimanckas . | |
| 3,382,837 | 5/1968 | Aumack | 440/55 |
| 3,463,032 | 8/1969 | Murphy, Jr. . | |
| 4,241,687 | 12/1980 | DuBois et al. | 440/63 |

FOREIGN PATENT DOCUMENTS

| | | |
|---|---|---|
| 47-22693 | 9/1972 | Japan . |
| 50-100299 | 4/1975 | Japan . |
| 53-3597 | 1/1978 | Japan . |
| 56-59500 | 5/1981 | Japan . |

*Primary Examiner*—Trygve M. Blix
*Assistant Examiner*—Thomas J. Brahan
*Attorney, Agent, or Firm*—Ernest A. Beutler

[57] ABSTRACT

An outboard motor embodying an improved steering mechanism that is operative to retain the motor in a preset steered position and which may be easily and automatically disengaged by the operator to permit steering under emergency conditions. In addition, the means for retaining the motor in its steered condition is operable from a remote position at the end of the tiller in proximity to the operator so that he need not remove a hand from the tiller to either engage or release the mechanisms. Furthermore, other controls for the engine are disposed at the end of the tiller in proximity to the steering control.

11 Claims, 3 Drawing Figures

STEERING DEVICE FOR AN OUTBOARD MOTOR

BACKGROUND OF THE INVENTION

This invention relates to a steering device for an outboard motor and more particularly to an improved and simplified control device for holding the motor in a steered condition and which may be readily released or engaged without the operator having to take his hands off the tiller.

There are many instances when it is desirable to hold an outboard drive in a fixed steered position without necessitating the operator having to continually hold his hand on the tiller. Various devices have been proposed for holding the outboard drive in such steered conditions. However, the device should be such that it can be conveniently engaged and disengaged and one in which the operator may readily steer the outboard drive in the case of emergency without necessitating release of the locking mechanism through a manual operation. In the copending application entitled "Steering Device For An Outboard Motor", Ser. No. 467,304, filed Feb. 17, 1983 in the name of Eifu Watanabe, and assigned to the assignee of this application, there is disclosed an improved, simplified device for controlling the steering of an outboard motor which achieves these results.

The device shown in that patent employs a locking member which may be selectively moved by the operator between a locked position in which it will be operative to retain the motor in a steered position, and a released position wherein the motor may be freely steered. That device also includes an emergency release wherein the operator may steer the motor even when the locking member is in its engaged position under emergency conditions. Although the device shown in that patent application has numerous advantages, the operator must be in proximity to the locking device in order to move it between its engaged and disengaged positions. That is, the operator must take one of his hands from the tiller so as to move the locking device between its two positions. Furthermore, in many applications, the motor is positioned rather remotely from the operator, in the case of motors embodying such devices as elongated tillers, and this may actually necessitate the operator leaving his seat to move into proximity to the motor so as to either engage or release the steering locking device.

It is, therefore, a principal object of this invention to provide an improved steering device for an outboard motor.

It is another object of the invention to provide an improved steering device for an outboard motor that is operative to releasably restrain the motor in a steered position and which may be engaged and released from a remote position.

It is a yet further object of this invention to provide a steering locking device for an outboard motor wherein the locking device may be operated without necessitating the operator removing a hand from the tiller.

SUMMARY OF THE INVENTION

This invention is adapted to be embodied in a steering mechanism for an outboard motor or the like comprising a drive shaft housing that is supported for steering movement about a generally vertically extending steering axis. A tiller is affixed to the drive shaft housing for controlling steering movement of the drive shaft housing about the steering axis. Releasable restraining means are provided for retaining the drive shaft housing in a preset steered condition. In accordance with this feature of the invention, operating means are provided for selectively controlling the releasable restraining means from the tiller.

DETAILED DESCRIPTION OF THE PREFERRED EMBODIMENT

Figure 1:
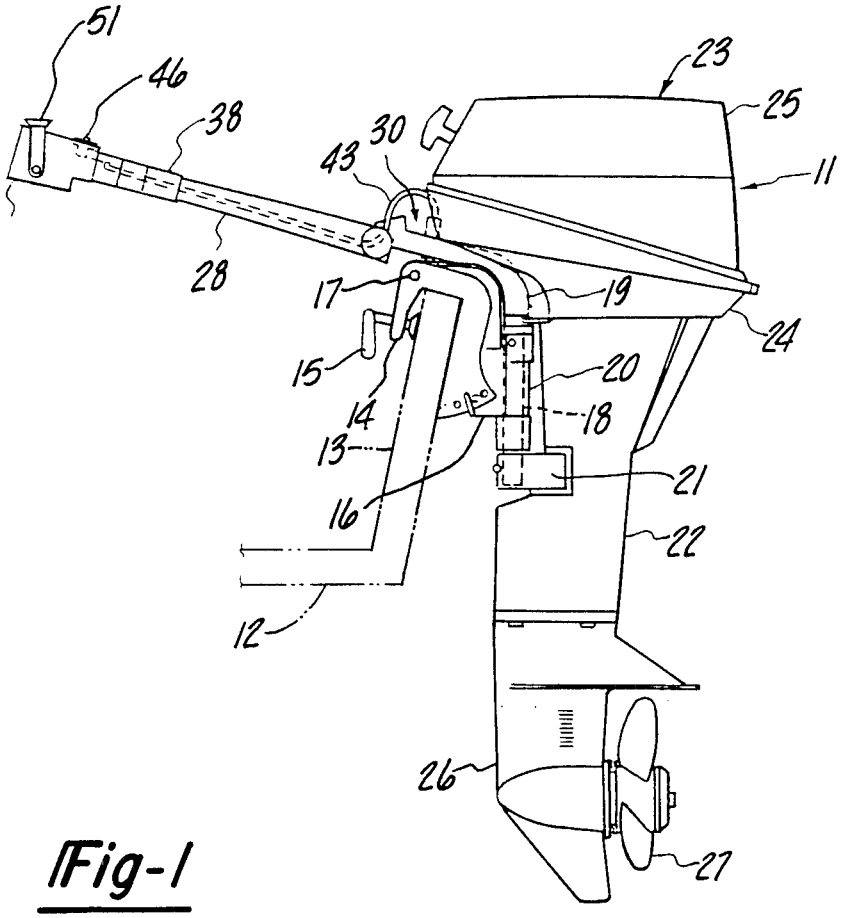
FIG. 1 is a side elevational view of an outboard motor constructed in accordance with an embodiment of this invention attached to the transom of a hull of an associated watercraft, which is shown in phantom.

Referring first to FIG. 1, an outboard motor having a steering arrangement constructed in accordance with an embodiment of the invention is identified generally by the reference numeral 11. The motor 11 is adapted to be affixed to the stern of a boat, shown in phantom, and identified by the reference numeral 12 and, particularly, to the boat transom 13. For this purpose, a clamping bracket assembly comprised of a pair of spaced generally C shaped members and indicated generally by the reference numeral 14 is provided with a pair of screw-like clamps 15 that affix the bracket 14 to the transom 13 in a known manner. A swivel bracket 16 is supported for pivotal movement about a substantially horizontally extending tilt axis upon the clamping bracket 14 by means of a pivot pin 17.

The swivel bracket 16 has a bearing portion 20 that journals a steering shaft 18 of the motor 11 in a known manner. This arrangement includes a steering bracket 19 fixed to the upper end of the steering shaft 18 and a lower bracket 21 to which a drive shaft housing 22 of the motor 11 is affixed in a known manner. The upper end of the drive shaft housing 22 carries the power head, indicated generally by the reference numeral 23, that consists of an internal combustion engine of any known type (not shown) that is enclosed within an outer cowling consisting of a tray 24 and a main cover portion 25. Depending from the drive shaft housing 22 is a lower unit 26 in which a propeller 27 is journaled. The propeller 27 is driven from the power head engine in a known manner which may include a forward, neutral reverse transmission contained in the lower unit 26.

The steering shaft 18 and, accordingly, power head 23, drive shaft housing 22 and lower unit 26 are rotated for steering movement about a generally vertically extending axis defined by the steering shaft 18 by means of a tiller 28. The tiller 28 consists of a generally forwardly extending handle having a base portion that is affixed to and pivotal about the steering bracket 19 in a known manner. In the illustrated embodiment, an extended tiller is employed, however, the invention is susceptible of use with tillers of any length.

The construction of the motor 11 as thus far described is conventional. For this reason, various details of its arrangement and operation have not been given because they are believed to be obvious and well known to those skilled in the art. In accordance with the invention, a device, indicated generally by the reference numeral 30, is provided for retaining the motor 11 in a predetermined steering condition. The device 30 is substantially the same in construction and operation as that in aforenoted application Ser. No. 467,304, except for the structure that achieves its manual actuation and release. Normally, the device 30 will be employed for releasably restraining the motor 11 in a condition that the associated boat is propelled forwardly without any change in its direction of travel.

Figure 2:
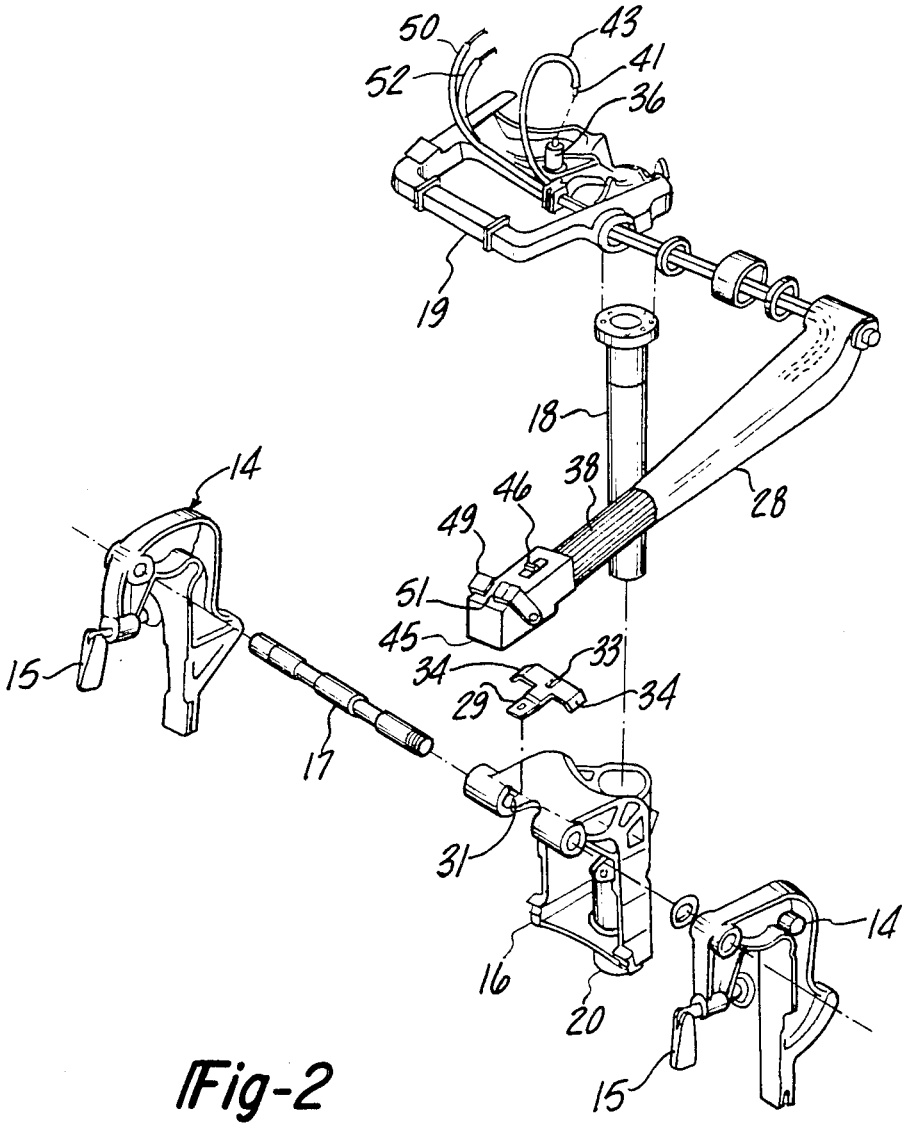
FIG. 2 is an exploded, perspective view showing the steering arrangement of the motor.

The device 30 includes a cantilevered leaf spring 29 (FIGS. 2 and 3) that is affixed at one of its ends to a boss 31 on the swivel bracket 16 by means of a bolt 32. The spring 29 has a generally T shape configuration at its other end and is formed with a central cylindrical detent recess 33. On either side of the recess 33, the leaf spring 29 is provided with downwardly extending bent projecting ends 34.

A locking member, comprising a detent pin 35, is adapted to cooperate with the leaf spring recess 33 so as to retain the motor 11 in a predetermined position. The pin 35 is slidably supported within a bushing 36 that is pressed or otherwise secured in a bore 37 formed in the steering bracket 19.

The detent pin 35 in the aforenoted copending application Ser. No. 467,304 was operated directly by the operator. It should be noted, however, that the tiller 28 is rather elongated and gas a hand grip portion 38 that is disposed at a substantial distance from the locking mechanism 30. Thus, with the previously proposed construction, it has been necessary for the operator to remove a hand so as to actuate the detent pin 35 between its released and its engaged position. In accordance with the invention, a remote actuator is provided for operating the detent pin 35 manually between its engaged and its released positions.

This remote operator includes a flexible wire 41 that is affixed at one of its ends to the detent pin 35, as by means of a connection and connecting pin 42. The wire actuator 41 is encircled for a major portion of its length by a protective sheath 43. One end of the sheath 43 is affixed, as by a threaded connection 44, to the bushing 36. The other end of the sheath 43 and the wire actuator 41 are threaded through the hollow interior of the tiller handle 28, entering at its point of pivotal support, and extend forwardly to terminate adjacent the hand grip portion 38.

A control box, indicated generally by the reference numeral 45, is carried at the forward end of the tiller 28 forwardly of the hand grip 38. The control box 45 contains and supports certain controls for the engine 23 including the actuating device for the steering device 30. The control box 45 has a hollow interior and slidably supports a steering lock control 46 on its upper end. The steering lock control 46 is connected, by means of a clevis 47, to the forward end of the wire actuator 41. The adjacent portion of the protective sheath is affixed to the interior of the tiller 28 adjacent the hand grip 38 by means of a fastener 48.

Figure 3:
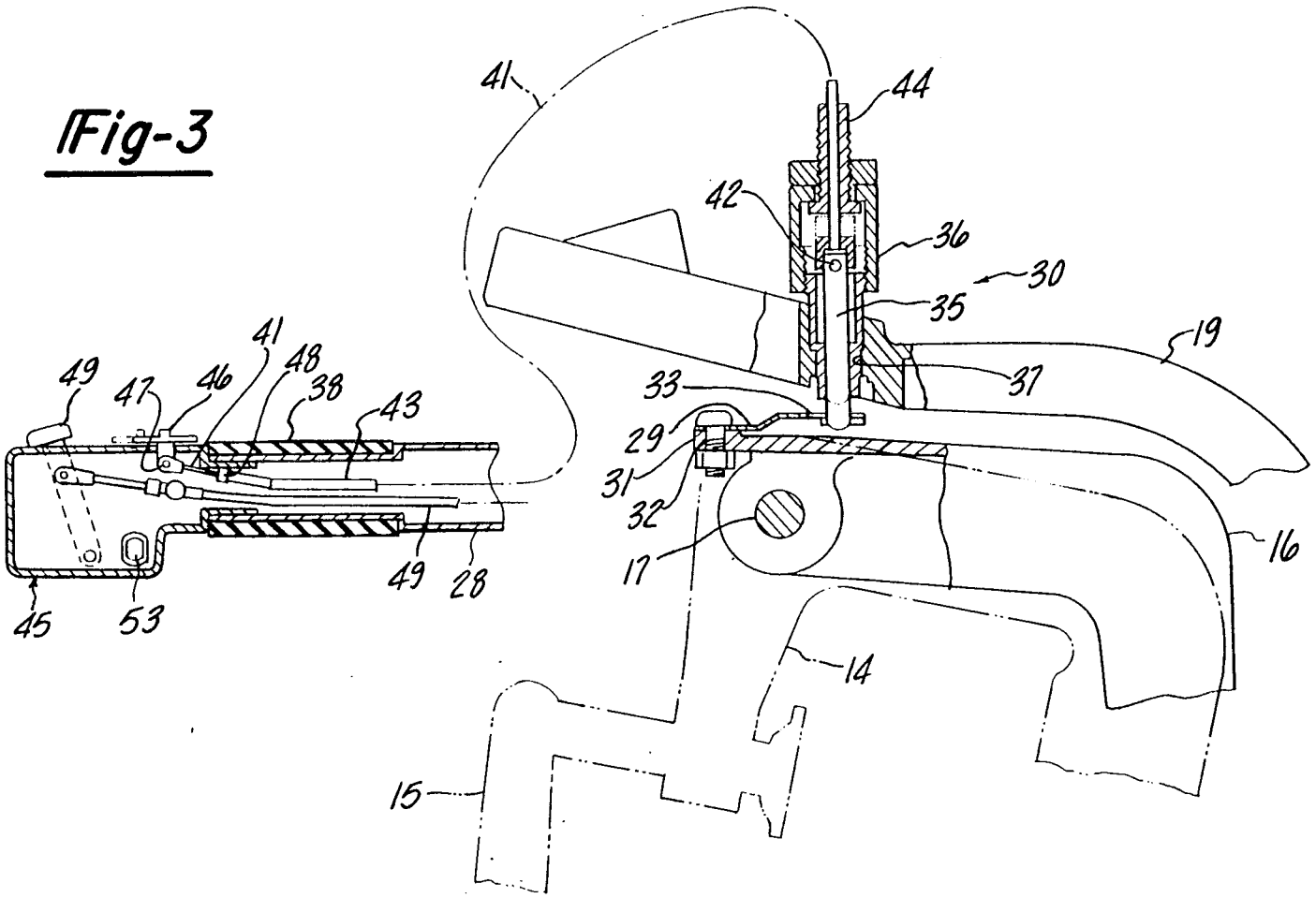
FIG. 3 is an enlarged side elevational view, with portions shown in section, illustrating the steering device.

The steering control lever 46 is slidably supported between a locked position, as shown in the solid line view in FIG. 3, wherein the lower end of the detent pin 35 is adapted to engage the detent recess 33 of the leaf spring 29. Alternatively, the control 46 may be slid forwardly to the dotted line position shown in this figure so that the detent pin 35 will be clear of the recess 33 and the motor may be steered without any interference from the device 30.

If the operator desires to retain the motor 11 in a position so that the boat will travel forwardly, he may engage the device 30 so as to restrain the motor in this condition. This is done by sliding the control 46 rearwardly so that the pin 35 will then enter the recess 33 and deflect the spring 29 slightly (FIG. 3). The pin 35 will thus be held in the engaged position as shown in FIG. 3 and the operator may leave his hands free of the tiller 28.

As may be seen from FIG. 3, it is only a rounded end of the pin 35 that enters the leaf spring recess 33. The force of the leaf spring 29 is sufficient to hold the motor 11 and specifically the power head 23, drive shaft housing 22 and lower unit 26 against steering rotation about the shaft 18 under normal loadings encountered due to engine vibration and water resistance when travelling in a straight ahead direction. However, in the event of an emergency, the operator may steer the motor 11 without releasing the device 30. This is accomplished by applying sufficient force to the tiller 28 so as to cause the rounded end of the pin 35 to cam itself out of the recess 33 through deflection of the leaf spring 29. The motor may then be steered without any interference from the device 30.

If the device 30 is retained in its latched position as shown in FIG. 3 and the motor 11 is returned to the straight ahead position, the rounded end of the pin 35 will contact either of the downwardly turned tabs 34 at one side of the spring 29, depending on which way the motor has been steered, and the rounded end may again enter the recess 33 when the rotor 11 is positioned at its straight ahead running condjition. Thus, the device 30 will be automatically reengaged without necessitating any actuation by the operator.

Of course, the device 30 can be released at any time by moving the control 46 forwardly. Because the control 46 is disposed immediately at the end of the tiller 28 on the control box 45, it is unnecessary for an operator to reach back to the motor 11 so as to reengage the device 30 or to release it. Thus, the operator can keep one or both hands on the tiller 28 and need not change his position in order to either release or engage the device 30.

In addition to carrying the control 46, the control box 45 may carry a throttle lever 49 that is pivotally supported and which is connected to a wire actuator device 50 that extends through the tiller 28 and which is connected at its end to the throttle control mechanism of the engine (not shown). In a similar manner, a shift lever 51 may be supported on the opposite side of the control box 45 from the throttle lever 49. The shift lever 51 is connected by a control wire 52 to the transmission control mechanism of the motor 11 in any suitable manner after it has passed through the tiller 28. Furthermore, an engine kill switch 53 may be supported on the control box 45 so as to short out the ignition of the engine contained within the power head 23 and stop it in a known manner.

It should be readily apparent from the aforenoted description that an improved device is provided for holding the motor in a steered condition and which can be released either automatically upon emergency operation through the operator moving the tiller 28 or, alternatively, released manually by a control device 46 that is positioned in proximity to the tiller handle grip 38 and which can be operated without the operator having to remove his hand from the tiller 28. In addition, the other controls for the engine normally employed are positioned in proximity to this control so that all control devices are readily accessible to the operator.

Although an embodiment of the invention has been described and illustrated, it should be readily apparent that various changes and modifications may be made, without departing from the spirit and scope of the invention, as defined by the appended claims.

I claim:

1. In a steering mechanism for an outboard motor or the like comprising a clamping bracket adapted to be affixed to the transom of a watercraft, a drive shaft housing, a steering shaft affixed to said drive shaft housing, a swivel bracket carried by said clamping bracket for pivotal movement about a horizontally extending axis, said steering shaft being supported for steering movement about a generally vertically extending steering axis by said swivel bracket, a steering bracket affixed to said steering shaft for steering of said drive shaft housing about said steering axis, an elongated tiller pivotally connected to said steering bracket for controlling steering movement of said motor about said steering axis, and releasable restraining means comprising a pair of positively interengaging elements for retaining said motor is a preset steered condition, the improvement comprising one of said elements being fixed relative to said swivel bracket and the other of said elements being carried by said steering bracket whereby said elements will pivot together about said horizontally extending axis, operating means carried at the forward end of said tiller for selectively controlling said releasable restraining means from said tiller and a flexible cable extending through said tiller for connecting said operating means to said releasable restraining means.

2. In a steering mechanism as set forth in claim 1 wherein the operating means comprises a control member supportable for movement between an engaged position and a released position.

3. In a steering mechanism as set forth in claim 2 wherein the control member is slidably supported by the tiller for movement between its positions.

4. In a steering mechanism as set forth in claim 3 wherein the tiller is provided with a hand grip portion and the slidably supported control member is contiguous to said hand grip portion.

5. In a steering mechanism as set forth in claim 4 wherein the control member is supported by a control box affixed to the forward end of the tiller and containing other controls for the outboard motor.

6. In a steering mechanism as set forth in claim 5 wherein the controls are interconnected with the elements of the motor which they control by wire actuators extending through the tiller.

7. In a steering mechanism as set forth in claim 1 wherein a pair of positively interengaging elements cooperate to prevent steering movement upon normal forces and to release the interengagement between said elements upon the exertion of greater than normal forces.

8. In a steering mechanism as set forth in claim 7 wherein the interengaging elements are positioned to interengage when the drive shaft housing is only in a specific orientation and wherein the interengaging elements offer no resistance to steering movement when the drive shaft housing is in other than that one position.

9. In a steering mechanism as set forth in claim 7 wherein one of the elements comprises a resilient member having a detent recess therein and the other of the members comprises a detent pin adapted to engage said detent recess.

10. In a steering device as set forth in claim 9 wherein the resilient member comprises a leaf spring and has a pair of downturned tabs on either side of the detent recess for engaging the detent pin and camming said spring so that said pin may engage said detent recess in said spring upon return of the drive shaft housing to a predetermined steering position.

11. In a steering mechanism as set forth in claim 1 wherein the releasable restraining means is biased to maintain the drive shaft housing in a first position and is yieldable upon the exertion of a predetermined force to said drive shaft housing for facilitating steering of said drive shaft housing, said releasable restraining means being automatically engageable upon return of said drive shaft housing to said first position.

* * * * *